US010309119B2

(12) United States Patent
Klein

(10) Patent No.: US 10,309,119 B2
(45) Date of Patent: Jun. 4, 2019

(54) CONTAINERS SHELTER

(71) Applicants: MIFRAM LTD, Kiriat Bialik (IL); Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 0 days.

(21) Appl. No.: 15/326,274

(22) PCT Filed: Jul. 14, 2015

(86) PCT No.: PCT/IL2015/050723

§ 371 (c)(1),
(2) Date: Jan. 13, 2017

(87) PCT Pub. No.: WO2016/009427

PCT Pub. Date: Jan. 21, 2016

(65) Prior Publication Data

US 2017/0198489 A1 Jul. 13, 2017

(30) Foreign Application Priority Data

Jul. 14, 2014 (IL) ..... 233641

(51) Int. Cl.

| | |
|---|---|
| ***E04H 9/10*** | (2006.01) |
| ***E04H 9/04*** | (2006.01) |
| ***E04B 1/343*** | (2006.01) |
| *E04H 1/12* | (2006.01) |
| *E04B 1/14* | (2006.01) |

(52) U.S. Cl.

CPC ..... *E04H 9/10* (2013.01); *E04B 1/34331* (2013.01); *E04B 1/34384* (2013.01); *E04H 9/04* (2013.01); *E04B 1/14* (2013.01); *E04H 2001/1283* (2013.01)

(58) Field of Classification Search

CPC ..... E04B 1/3483; E04B 1/34336; E04H 2001/1283; E04H 1/04; B65D 88/022

See application file for complete search history.

(56) References Cited

U.S. PATENT DOCUMENTS

| | | | | |
|---|---|---|---|---|
| 4,722,155 | A * | 2/1988 | Ericsson | E04H 9/10 52/127.4 |
| 5,501,046 | A * | 3/1996 | Hattingh | E04B 1/34321 52/266 |
| 8,484,929 | B1 | 7/2013 | Begdouri | |
| 2003/0188507 | A1 | 10/2003 | Cote, Jr. | |
| 2011/0036022 | A1* | 2/2011 | Hsu | E04B 1/3483 52/79.1 |
| 2012/0151851 | A1 | 6/2012 | Cantin et al. | |
| 2013/0160379 | A1* | 6/2013 | Balfantz, III | E04H 1/005 52/79.1 |
| 2014/0008359 | A1* | 1/2014 | Ferren | B65D 88/121 220/1.5 |

(Continued)

*Primary Examiner* — Brian D Mattei
*Assistant Examiner* — Daniel J Kenny
(74) *Attorney, Agent, or Firm* — William Dippert; Laurence Greenberg; Werner Stemer

(57) ABSTRACT

A containers shelter is formed from a base array of 20 ft containers, having a sheltered inner area therebetween, and, from a second floor of 40 ft containers that are connected to the base array of containers and cover entirely the sheltered inner area. The containers are filled with a filling material. The base array comprises an entrance container having an inner opening that is transversely directed to an outer opening.

14 Claims, 4 Drawing Sheets

(56) References Cited

U.S. PATENT DOCUMENTS

| | | | | |
|---|---|---|---|---|
| 2015/0240474 | A1* | 8/2015 | Kokoschka | F02B 63/044 52/79.1 |
| 2016/0130795 | A1* | 5/2016 | Downey | E04H 5/00 52/79.1 |

* cited by examiner

CONTAINERS SHELTER

CROSS-REFERENCE TO RELATED PATENT APPLICATIONS

This patent application is a U.S. National Phase Application filing under 35 U.S.C. § 371 of PCT Patent Application No. PCT/IL2015/050723, filed Jul. 14, 2015, which in turn is based upon and claims the benefit of the filing date of Israeli Patent Application No. 233641, filed Jul. 14, 2014, each of which is incorporated herein by reference in its entirety.

FIELD OF THE INVENTION

The present invention relates to the field of human shelters erected in armed conflict zones, and more particularly to the field of shelters that can be easily erected on site in conflict zones and can contain a large number of troops.

BACKGROUND OF THE INVENTION

In many battle fields, when it is necessary to protect the troops, trenches are being digged, or protective walls are being erected. For many years, the protective walls were made of sacks filled with local earth or sand. This system is very cheap and easy to implement since it can be carried out by relatively small sacks that, when filled, can be easily carried out by a person. Thus, if enough sacks are piled, they enable enough protection against light and medium flat-trajectory weapons like rifles and machine guns.

In many armed conflict zones around the world, there is a need to protect the military forces from being injured by steep-trajectory weapons, like rockets, missiles, and mortars. In this case, piling of sacks filled with earth or sand is not satisfactory since there is a need to supply enough protection from the upper side as well.

A large variety of structures and solutions are used, such as shelters, bunkers or other types of constructed buildings. Despite the fact that these structures provide the necessary protection, they suffer from various disadvantages; they are very expensive, require a large erection time, and cannot be re-used in another site.

In order to provide a sheltering structure that protects against steep-trajectory weapons, various solutions are known in the market.

A structure known as "Mivtsar Yehuda" (namely, Yehuda Fortress) by Yehuda Fences Ltd. (www.yfence.co.il), is a military fortification structure that is designed for fast erection for protection of a maritime container in the size of 600×250×250 cm. The "Mivtsar Yehuda" consists of elements that are constructed of a galvanized steel net envelope, and an inner sheet made of a UV protected geo-textile cloth.

When these elements are filled with earth they form a bulged box-like shape. Placing the filled elements one adjacent the other enables to erect a protective structure around the container. However, a main disadvantage of this structure is that the basic elements cannot be used directly for building a protective roof.

Thus, in order to enable placing of the earth-filled elements as a protective roof, first, a special steel structural frame has to be erected, whether it is a one-piece structure, or, a modular structure made of steel beams, rods and plates that are modularly connected to each other in order to form a strong structure that can withstand a high load thereon without collapsing. Second, the steel structural frame is placed on the previously erected structure of filled elements, and then, third, new filled elements are placed on the structural frame to be used as a protective roof.

Since the structural frame has a relatively high height in order to withstand the heavy loads apply thereon, it exposes the protected item, in this case, the container, to medium inclination trajectory exploding items. Thus, it is necessary to form the structural frame large enough, i.e., with a large overlapping relative to the vertical walls made by the filled elements, in order to assure that the container is well protected from the top side. Furthermore, if an explosive charge falls and explodes adjacent the entrance to the protected area, there is a direct line of explosion towards the protected area. This problem could be avoided just with addition of a substantial number of filled elements.

HESCO Bastion Ltd. (www.hesco.com), based in the UK, manufactures a force protection product known as a Concertainer unit. The Concertainer unit is a multi-cellular wall system manufactured from welded Zinc-Alu coated steel wire mesh and joined with vertical, helical coil joints. The units are lined with heavy-duty non-woven polypropylene geotextile. The Concertainer units use locally available fill material to rapidly construct defensive barriers and other structures with minimal manpower and resources.

The Concertainer units can be extended and joined together to provide effective and economical structures according to threat needs and level of protection required.

A rapid in-theatre deployment utilizes a specially designed and engineered container to provide a significant increase in the quantity of Concertainer units that can be transported in a 20 ft ISO container footprint.

HESCO have developed the HLBR (HESCO lightweight bunker roof), a rapid and easily erectable lightweight roof specifically designed to provide protection against IDF weapons. The roof can be built on almost any walls capable of taking the load that the roof will impose upon it. Again, this roof is a specially built item in order to withstand the load applied thereon, and it cannot be made from the same units that form the walls.

An HESCO bunker set has been developed to utilize 40 ft and 20 ft ISO containers. Walls are constructed using specifically adapted Mil 1 Concertainer units to give a protective wall thickness of in excess of 1 m. The roof design provides 0.6 m of overhead cover. Material bunkers provide access from one end of the bunker, while personnel bunkers provide access from both ends. Again, in this design, the roof cannot utilize the same units forming the walls.

It is the object of the present invention to provide a shelter for armed forces that significantly reduces or overcomes the aforementioned disadvantages.

It is a further object of the present invention to provide a shelter for armed forces that is made entirely from common 20 ft and 40 ft ISO containers.

It is still a further object of the present invention to provide a shelter wherein its roof and walls are made from the same structural elements.

It is still yet a further object of the present invention to provide a shelter for armed forces that can be easily and quickly erected and disassembled.

It is also a further object of the present invention to provide a shelter for armed forces that can be entirely re-used.

It is another object of the present invention to provide a shelter for armed forces that has a large capacity.

It is still yet another object of the present invention to provide a quick-erection shelter that provides safe entrance to the space within.

It is still further another object of the present invention to provide a safe 360-degrees shelter, against flat-trajectory and steep-trajectory weapons, from above and sides.

It is also another object of the present invention to provide a collapsible shelter that forms a rigid structure when erected.

It is yet another object of the present invention to provide a shelter for armed forces that can be additionally protected after being completely erected.

SUMMARY OF THE INVENTION

The shelter according to the present invention is formed from 20 ft and 40 ft standard intermodal containers. The intermodal container is also known as; container, freight container, ISO container, shipping container, hi-cube container, box, conex box, and sea can. Each container has a steel frame made of profiled beams, and is covered with shaped metal sheets therebetween. The construction of the container enables loading it with a considerable weight without the container being collapsed or falling apart. The containers may be box containers, i.e., closed containers, or, open top containers. Regardless of the type of container, i.e., box container or open top container, each container is provided with a set of winged doors in the short dimension of the container.

The advantage of the shelter according to the present invention is that it utilizes standardized reusable steel boxes that can be easily transported, whether by trucks, trains, or ships. The standard sizes of the containers enable using them without a need to specifically manufacture a custom made steel box.

The containers shelter according to the present invention has triple protection for the troops therein. The construction of a container itself provides at least two steel barriers, whether these are beams, rods or plates that neutralize the explosion effect of any weapon directed to the containers shelter, and, the filling within the containers absorbs any shock waves or explosion sprays.

In accordance with the present invention there is provided a containers shelter comprising:

a base array of containers, and a second floor of containers, wherein the second floor of containers are positioned on top of the base array of containers.

Typically, the base array of containers defines a sheltered inner area therebetween.

Advantageously, the second floor of containers covers entirely the sheltered inner area.

Further advantageously, the second floor of containers covers entirely the base array of containers.

Practically, the second floor of containers defines a shelter inner space between the ground, the base array of containers, and, the second floor of containers.

If desired, the containers of the base array of containers and of the second floor of containers are ISO containers.

Typically, the containers are open-top containers or box containers.

Practically, each of the box containers has a top surface, and, at least a major portion of the top surface is cut away.

If desired, the containers of the base array of containers are filled with a filling material up to their entire height.

Typically, the filling material may be local sand, earth, stones, gravel, concrete, reinforced concrete, or any other delaying material that may absorb any possible explosion.

If desired, the second floor of containers is filled up to their entire height with a filling material that may be local sand, earth, stones, or gravel, or, up to a partial height with concrete or reinforced concrete.

Advantageously, the base array of containers is formed from 20 ft ISO containers.

Further advantageously, the second floor of containers is formed from 40 ft ISO containers.

Practically, the base array of containers comprises an entrance container.

Typically, the entrance container comprises an outer opening, an inner opening remote from the outer opening and transversely directed thereto, and, a separation wall extending between the outer opening and the inner opening up to an entire height of the entrance container.

If desired, the base array of containers and the second floor of containers are connected to each other by means of twist-lock fasteners.

Alternatively, at least a part of the containers are provided from within with sliding rails along at least one on the longitudinal walls of the container, and a pre-casted reinforced concrete wall is slidingly inserted into the rails.

According to a specific embodiment, at least one container comprises therein a slanted protective plate that extends from a container corner, adjacent a long wall of the container, to an opposite container long wall.

Practically, a slanted space formed between the slanted protective plate and the long wall of the container rising from the container corner is filled with a filling material.

If desired, an external wall of at least one container is provided with a pair of vertically extending rails, and a vertical protective plate is placed between the rails.

Further if desired, the vertical protective plate may be formed from steel, from pre-casted reinforced concrete, or, may be an active protection plate as known in the art.

Further in accordance with the present invention there is provided a method for erecting a containers shelter, the method comprising the steps of:

1—placing a base array of containers on level ground defining a sheltered inner area therebetween, the base array having at least one entrance container comprising an outer opening, an inner opening remote from the outer opening and transversely directed thereto, and, a separation wall extending between the outer opening and the inner opening up to an entire height of the entrance container.

2—filling the base array of containers with a filling material up to the entire height of the containers.

3—placing a second floor of containers on top of the base array of containers such that the second floor of containers covers entirely the base array of containers.

4—filling the second floor of containers with a filling material.

Advantageously, the base array of containers is formed from 20 ft containers and the second floor of containers is formed from 40 ft containers.

BRIEF DESCRIPTION OF THE DRAWINGS

For a better understanding of the present invention and to show how the same may be carried out in practice, reference will now be made to the accompanying drawings, in which.

DESCRIPTION OF PREFERRED EMBODIMENTS

Figure 1:
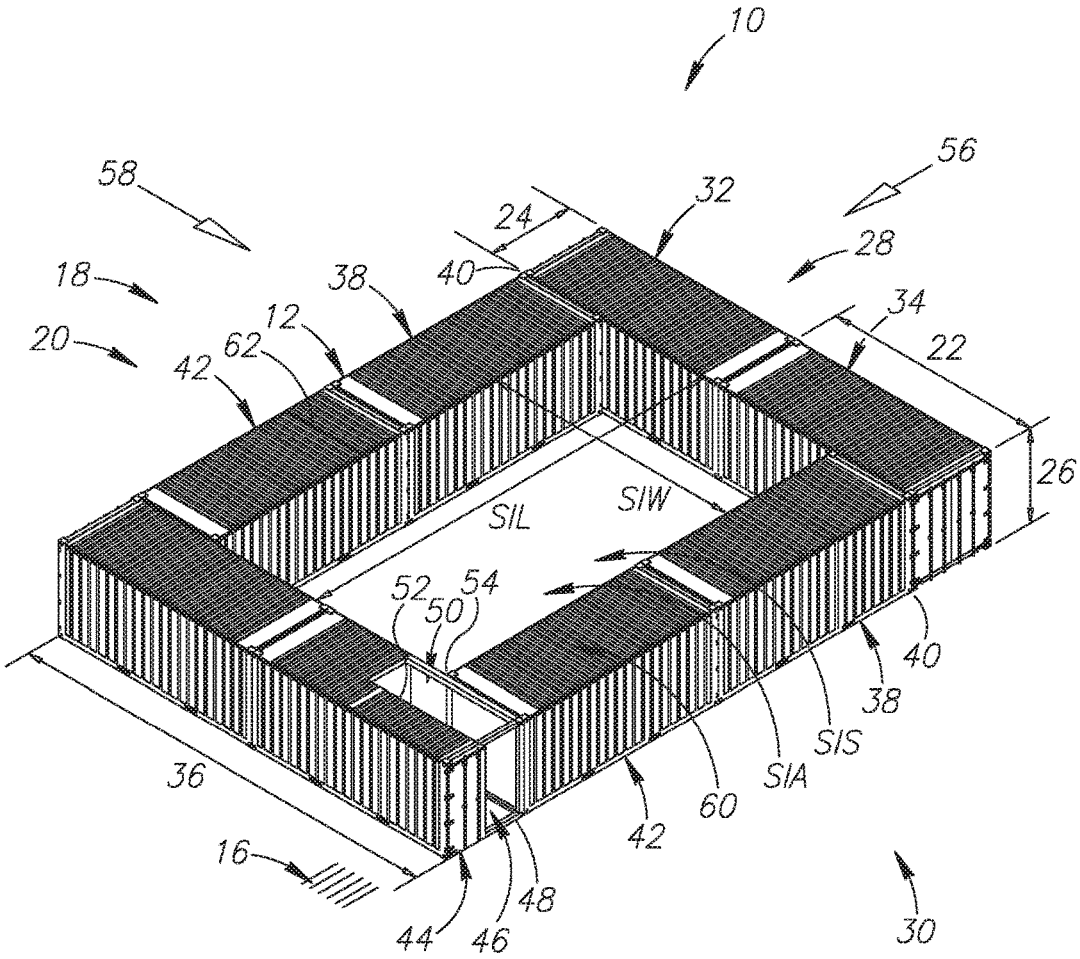
FIG. 1 is a perspective view of a base floor of a containers shelter according to the present invention.
Figure 2:
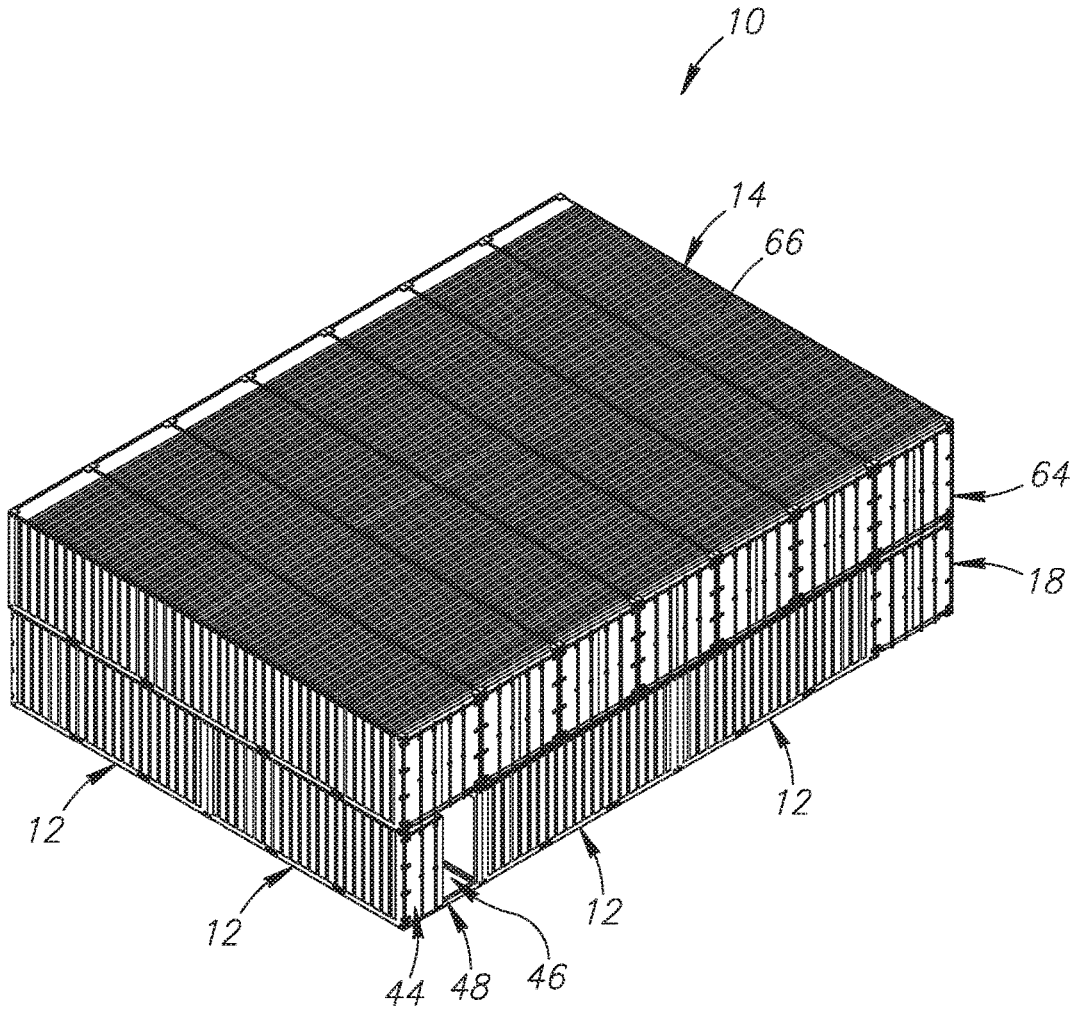
FIG. 2 is a perspective view of the erected containers shelter.
Figure 3:
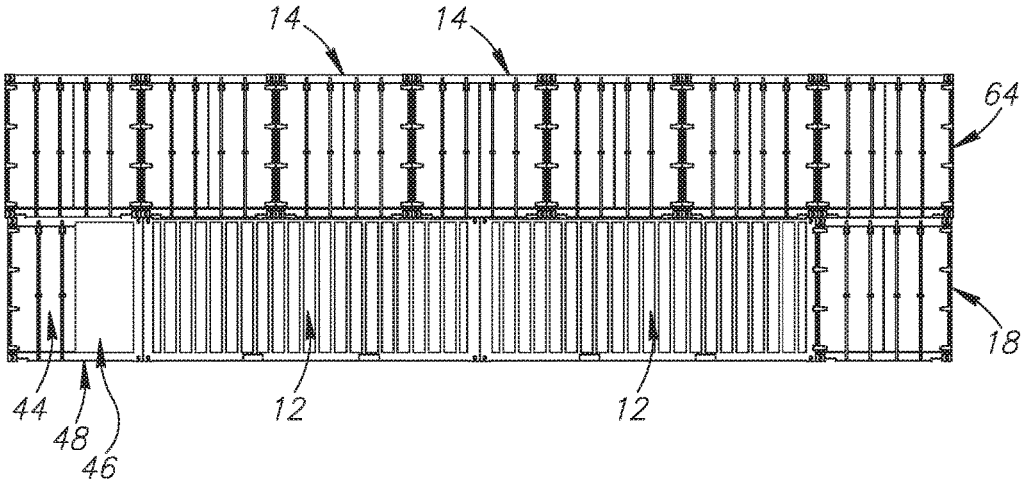
FIG. 3 is a side view of the containers shelter of FIG. 2 shown from the array long side.

Attention is drawn to FIGS. 1-3 that show a containers shelter 10 according to the present invention. The shelter is formed from 20 ft standard intermodal containers 12 and from 40 ft standard intermodal containers 14. The containers shelter 10 is best utilized when placed on a level ground 16. The level ground 16 may be formed from a variety of substances, e.g., sand, earth, gravel, coarse sand, natural grass, grass, wood, or, concrete.

FIG. 1 shows the construction of a base floor 18 of the containers shelter 10 according to the present invention. A "base floor" means that only one level of containers is placed, without any further container placed thereon. The base floor 18 is formed from a base array 20 of 20 ft containers 12. The containers may be box containers, or, open top containers. Each 20 ft container 12 has a 20 ft container length 22, in a longitudinal dimension thereof, a 20 ft container width 24, in a width dimension thereof that is perpendicular to the longitudinal dimension thereof, and, a 20 ft container height 26.

It should be noted that directional terms appearing throughout the specification and claims, e.g. "forward", "rear", "upper", "lower" etc., are used as terms of convenience to distinguish the location of various surfaces relative to each other. These terms are defined with reference to the figures, however, they are used for illustrative purposes only, and are not intended to limit the scope of the appended claims.

The base array 20 comprises an array short side 28 and an array long side 30 transversely directed to the array short side 28 and advantageously perpendicular thereto. According to a preferred embodiment of the present invention, the array short side 28 comprises a first short side 20 ft container 32 and a second short side 20 ft container 34 that are placed one against the other with their 20 ft container width 24 abutting each other. Thus, a straight and continuous 40 ft structure has been received, with a short side total length 36 of 40 ft.

At a second stage, the array long side 30 is erected, as can be clearly seen in FIG. 1. At this stage, when the array short side 28 has being set, a first long side container 38 is placed such that its width dimension abuts against a free end 40 of the longitudinal dimension of the first short side container 32. At this stage, a 90° structure is formed between the first short side container 32 and the first long side container 38. The same process is repeated adjacent the second short side container 34. Namely, another first long side container 38 is placed such that its width dimension abuts against a free end 40 of the longitudinal dimension of the second short side container 34. In this position, a shelter inner width SIW is created between the two first long side containers 38.

At a next stage, a second long side container 42 is placed adjacent each of the first long side containers 38, such that their width dimensions abut each other. Finally, the first step is adversely repeated. Namely, another array short side 28, made of two 20 ft containers 12, is placed against the free ends of the second long side containers 42. In this position, a shelter inner length SIL is created between the two array short sides 28. Now, a shelter inner area SIA is created in the area confined between the two array short sides 28 and the two array long sides 30.

Thus, the shelter inner length SIL equals to:

$$SIL=2\times(20\text{ ft container length})$$

The shelter inner width SIW equals to:

$$SIW=[2\times(20\text{ ft container length})]-[2\times(20\text{ ft container width})]$$

And, the shelter inner area SIA equals to:

$$SIA=SIL\times SIW$$

In order to provide entrance to the shelter inner area SIA, the last placed container of the last placed array short side 28 serves as an entrance container 44. The entrance container 44 is provided with a pre-built entrance hall 46 that typically has a width of 1.1 m. The entrance hall 46 comprises an outer opening 48, formed in the width dimension of the entrance container 44, and, an inner opening 50, formed in the length dimension of the entrance container 44 and transversely directed to the outer opening 48.

A separation wall 52 is formed, inside the entrance container 44, between the outer opening 48 and the inner opening 50. The separation wall 52 is typically formed from a 6 mm-thick steel and it extends along the entire height of the entrance container 44. The purpose of the separation wall 52 is to separate between the entrance hall 46, that should serve people, and the rest of the entrance container 44 that should be filled as will be later described.

It should be noted that the inner opening 50 does not have to be located where shown, i.e., on the long side of the entrance container 44 adjacent a corner 54 of the second long side container 42. Alternatively, the inner opening 50 may be formed on the long side of the entrance container 44, adjacent a short side of the entrance container 44 and far from the corner 54 of the second long side container 42. It is understood that in this case, the path of the separation wall 52 should be amended accordingly.

Even though it is not necessarily required from safety reasons, sometimes it may be desired to install doors at the outer opening 48, at the inner opening 50, or at both of them. This may be practical in a case where atmosphere control units are used within the erected containers shelter 10. The atmosphere control units may be, but not limited to, air conditioning or heating. In a case where these doors (not shown) are rigid enough, they may provide extra protection for people passing through the entrance hall 46.

In FIG. 1, the path of the entrance hall 46 as shown is for illustrative purposes only, and it should be clear that no part of the frame of the entrance container 44 is cut off neither any walls or top surface of the entrance container 44 are un-necessarily removed. In FIG. 1, the top surface of the entrance hall 46 is shown transparent in order to better show the inner opening 50. If desired, for practical reasons, a 3 m-length portable concrete wall (not shown) may be located in front of the outer opening 48 in order to increase the safety of the people during their passage in the entrance hall 46.

The location of the entrance hall 46 is chosen such that it is farthest from the side being threatened. Thus, the threats may come from a first threat direction 56 that is directed toward the array short side 28 that is farthest from the outer opening 48, from a second threat direction 58 that is directed toward the array long side 30 that is farthest from the outer opening 48, or, from any direction inbetween.

Now, when the base array 20 is erected, the containers are filled from above, up to their entire height, with a filling material 60. The filling material 60 may be local sand, earth, stones, gravel, concrete, reinforced concrete or any other delaying material that may absorb any possible explosion without affecting the sheltered troops. The filling of the filling material 60 is being accomplished quickly and easily by means of a power shovel or a backhoe loader.

According to a specific use of the present invention, the filling material 60 may be filled into big sacks (not shown) prior to being inserted into the container. Each big sack (also called "big bag") has a typical volume of 0.4 cubic meter to 1.0 cubic meter. The use of big bags encounters several advantages. First, the big bags may be pre-filled in a remote location, in that manner, they may be filled where filling material, or, bulks of filling material are available, without being dependent on existence of filling material in the erection site at the conflict zone. Second, the big bags may be filled at a convenient time, and not during conflict periods. Third, the big bags may be stored filled and ready for shipment at a vertically rising array containing a multitude of levels of filled big bags. Fourth, the filled big bags may be transported in a variety of vessels, like an open truck, trailer truck or a closed box truck. Fifth, the filled big bags may be loaded into the containers, in addition to the already mentioned vehicles, also by a forklift or a crane. Sixth, the loading time becomes faster since it is possible to lift several big bags together in a single lift of a crane. Seventh, the big bags may be easily unloaded and transported for being re-used. Eighth, the necessity to lift and tilt the containers for unloading the filling material is avoided. Ninth, it is easier to load big bags to second floor of containers by using a crane than lifting bulk filling material by a bugger. Tenth, the entire loading and unloading process becomes a clean and aesthetic process.

If open-top containers are being used, the filling task is done without a necessity to make any modifications in the containers. If box containers are used, it is necessary to cut away a major portion of the containers' roof, being a top surface 66 of the container. During this task, care should be taken not to cut any transverse reinforcing beams 62 (as the one shown in FIG. 1) that form a part of a container's frame, thus not weakening the structure of the container.

At this stage, as shown in FIG. 2, a second floor 64 of containers is erected. In this case, 40 ft containers 14 are placed over the base floor 18 in order to be used as a protective roof. As with the base floor 18, the 40 ft containers 14 may be open-top or box containers, in which case it is necessary to cut away a major portion of the container's roof, as described above. The second floor containers are typically filled with concrete or a reinforced concrete to a height of 1-2 meters, depending on the assumed threat level, or, they are fully filled with sand or ground to their entire height.

Since the second floor containers are not easily accessible as the base floor containers, the filling of the second floor containers may be slightly different. A first option is to fill the 40 ft containers 14 on the ground and then lift them to the second floor 64. This option requires to have on field a relatively large crane that is capable of lifting a 40 ft loaded container. Another option is to lift loaded big-sacks, having a capacity of about 1,000 Kg, by means of a light crane or a boomed forklift, and to spill the sack's load into the containers that are already placed on the second floor. Another option is to utilize a mobile ramp for a small bulldozer and piling the filling material into the 40 ft containers by means of the small bulldozer.

The erection of the second floor 64 is such that the 40 ft containers 14 are parallel to the array short side 28 and cover exactly the length of two 20 ft containers 12. Thus, the 40 ft containers 14 are lifted one-by-one and placed adjacent each other until the final enclosed formation is obtained.

The entire containers shelter 10 is massive, heavy, and may withstand shock waves and explosion sprays. However, if it is required to increase the rigidity and survivability of the entire containers shelter 10, the containers may be connected to each other by means of twist-lock fasteners, in the same manner as containers are fastened on board a ship in order to prevent any relational movement therebetween. In this case, adjacent containers of the base floor 18 and of the second floor 64 are connected to each other. Furthermore, the containers of the second floor 64 are connected to the containers of the base floor 18 on which they rest upon.

The height of the base floor containers may be 2.438 m or 2.896 m which are the common heights of the ISO containers. However, for practical reasons, it is required that all the containers of the base floor 18 be of the same height. Furthermore, typically the 20 ft containers are of the shorter height mentioned above, and the higher height is typically available only at 40 ft containers.

According to the above described embodiments, the shelter inner width SIW is 7 m, and the shelter inner length SIL is 12 m. This provides a shelter inner area SIA of 84 sqm which is quite large for accommodating a large number of troops, with or without their personal gear. The spacious area may be used as a rest area, gathering area, or meeting area. Furthermore, by multiplying the shelter inner area SIA by the base floor height, which, as was mentioned above, is practically 2.438 m or 2.896 m, a shelter inner space SIS is obtained, which, in the above embodiment has a volume of 204.8 cubic meters or 243.3 cubic meters.

When the threat to the armed troops has ceased and it is required to dismantle the containers shelter, the doors of each of the containers are opened and the other side of the containers are lifted thus enabling the filling material to be spilled out easily.

The present invention also provides a method for erecting a containers shelter. The method comprising the steps of:

1—Placing a base array of containers on level ground defining a sheltered inner area therebetween, the base array having at least one entrance container comprising an outer opening, an inner opening remote from the outer opening and transversely directed thereto, and, a separation wall extending between the outer opening and the inner opening up to an entire height of the entrance container.

2—Filling the base array of containers with a filling material up to the entire height of the containers.

3—Placing a second floor of containers on top of the base array of containers such that the second floor of containers covers entirely the base array of containers.

4—Filling the second floor of containers with a filling material

Although the present invention has been described to a certain degree of particularity, it should be understood that various alterations and modifications could be made without departing from the spirit or scope of the invention as hereinafter claimed.

For example, in a case where there is no crane on field and the second floor 40 ft containers 14 are lifted by means of a large container forklift, it may be advisable to place first the first long side containers 38 and the second long side containers 42, in the appropriate distance therebetween. Then, a second floor 40 ft container 14 is placed thereon, as a center container of the second floor 64. From that point forward, the rest of the containers, being of the base floor 18 or of the second floor 64 are placed according to the accessibility of the forklift.

Although the containers shelter 10 has been described with reference to a specific number of 20 ft containers and 40 ft containers, i.e., eight 20 ft containers and seven 40 ft containers, the present invention is not limited to that form of array. The only condition is that the base floor be fully covered by the second floor containers.

Thus, e.g., the array short side may be formed from two 20 ft containers as described above. However, the array long side may contain any other number of containers, and they may be 20 ft containers or 40 ft containers. In this case, the second floor comprises a multitude of 40 ft containers that cover entirely the array short sides and the array long sides.

The entire base floor does not have to be formed from 20 ft containers and it may be formed entirely from 40 ft containers. In this case four 40 ft containers will replace the eight 20 ft containers of the above embodiment.

According to a specific embodiment, where there are no 40 ft containers available, there is a possibility to use only 20 ft containers. In this case, the shelter inner width will be very limited since the second floor is formed from a 20 ft container, and a minimum overlapping between the base floor and the second floor has to be assured.

The containers shelter is not limited to have only one outer opening or only one entrance container and additional entrance containers may be placed as a base floor, providing additional outer openings that may increase the ventilation within the shelter and also the mobility of troops into and out of the containers shelter. The ventilation and mobility factors are more significant in a case where the array long side of the containers shelter is extended as explained above.

The outer opening 48 and the inner opening 50 of the entrance container 44 do not have to be transversely directed to each other. Thus, if desired, the outer opening and the inner opening may be parallel to each other. Furthermore, they me formed along a straight line or skewed with respect to each other.

The containers shelter 10 was described above with respect to protection of troops staying in the sheltered inner space SIS, however, in a case where it is necessary to protect an object that is higher than the height of the base floor containers, the above described array should be amended to suit the higher height required in the sheltered inner space SIS. In this case, another array similar to the base array 20 has to be erected on top of the base array 20, and just then, the 40 ft containers 14 are placed on top to serve as a protective roof.

According to another embodiment of the present invention, the containers do not have to be filled with a filling material. In this case, the containers are provided from within with sliding rails along both longitudinal walls of the container. A pre-casted reinforced concrete wall is slidingly inserted into each of the rails. The pre-casted reinforced concrete wall has a typical thickness of 15 cm, and is installed adjacent each of the longitudinal walls of the container.

For better protection, two spaced apart pre-casted reinforced concrete walls are used in each container, however, only one wall may be sufficient, in which case, it will be installed adjacent an external side of the container.

The above mentioned rails may be equally used in 20 ft containers as well as in 40 ft containers. Typically, when this method is used, it is implemented on the base floor containers only. However, it is not restricted to the base floor containers only and it may be implemented also to the second floor containers.

In a case where additional protection is required, the containers provided with pre-casted reinforced concrete walls, whether having one wall or two spaced apart walls, are additionally filled with filling material of a type and in a manner as described above.

Figure 4:
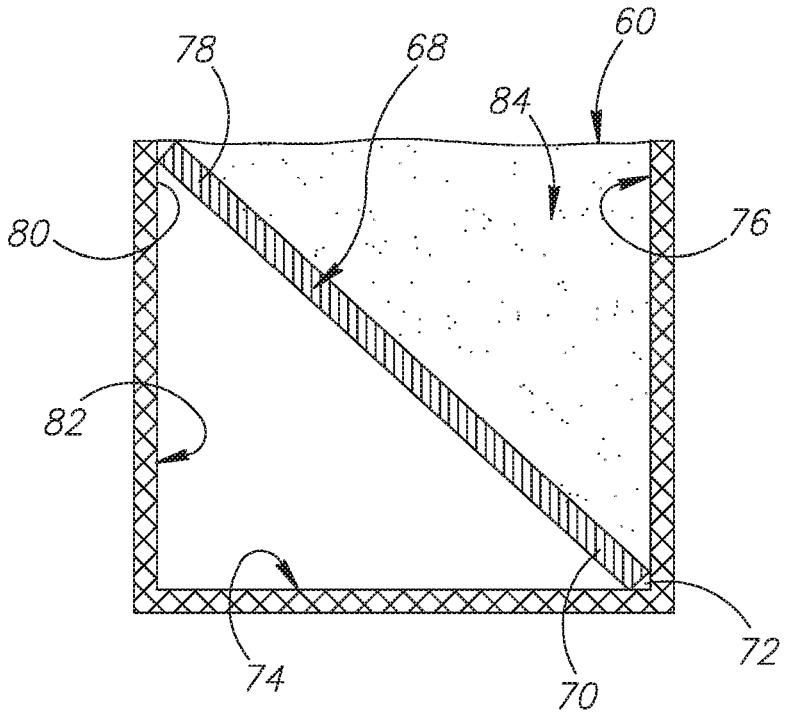
FIG. 4 is a cross-sectional view of a container width with an inclined protection plate assembled therein.
Figure 5:
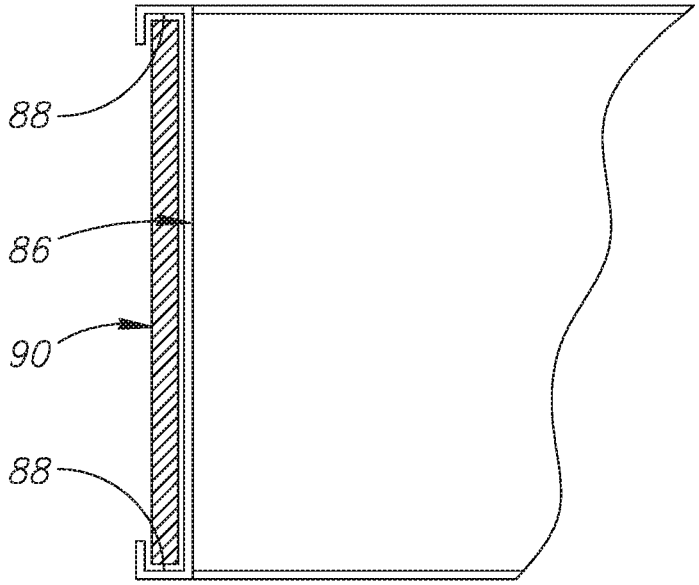
FIG. 5 is a partial top view of a container having a protection plate assembled thereon.

According to some embodiments, the containers are provided with a slanted protective plate 68 as shown in FIG. 4. The slanted protective plate 68 may be formed from steel, from pre-casted reinforced concrete, or from any other suitable construction. The slanted protective plate 68 extends along the entire length of the container that it is positioned therein and is positioned such that a lower end 70 of the slanted protective plate 68 abuts against a container corner 72 that is formed between a container floor 74 and a container external long wall 76, and, an upper end 78 of the slanted protective plate 68 abuts against a wall upper end 80 of a container internal long wall 82 that is opposite to the container external long wall 76.

At a second stage, a slanted space 84 that is formed between the slanted protective plate 68 and the container external long wall 76 is filled with filling material 60 in the same manner as described above. The slanted protective plate 68 may be implemented in 20 ft containers and in 40 ft containers. Furthermore, the slanted protective plate 68 may be implemented in the base floor containers 18, in the second floor containers 64, or at both floors.

Preferably, the orientation of the slanted protective plate 68 is such that the slanted space 84 with the filling material 60 filled therein are facing toward the threat directions, thereby providing better protection to the shelter inner space SIS.

In some cases, where extra protection is required, the external walls 86 of a container may be provided with a pair of spaced apart vertically extending rails 88. The rails 88 may be integrally formed with the container, e.g., by being welded thereto, or, may be detachably connected to the container, e.g., by bolts. A vertical protective plate 90 is inserted between each pair of rails 88. The vertical protective plate 90 may be formed from steel, from pre-casted reinforced concrete, or, may be an active protection plate as known in the art.

The vertical protective plates 90 may be implemented on external walls of each of the containers, i.e., on 20 ft containers, and, on 40 ft containers. Furthermore, the vertical protective plates 90 may be implemented on the base floor 18 as well as on the second floor 64.

According to some embodiments, where there arises a need to provide shelter to vehicles as well, two methods are used. According to a first method, at least one of the containers of the base floor of containers is converted into a passageway-container. The passageway-container may be a container from the array short side or from the array long side. In order to enable passage of vehicles therethrough, at least a portion of the container long side, at both sides thereof is cut away, typically, in a length of about 3 m, so that a vehicle may drive through the two openings formed in the long sides of the passageway-container. If it is necessary to compensate for the loss of safety and protection when using a passageway-container, an array of one or more containers filled with a filling material may be positioned out of the containers array, opposite the openings in the passageway-container, and distanced away therefrom, thus preventing any nearby explosion from affecting the shelter inner space.

According to a second method, one of the containers of the base floor, preferably of the short side array, is moved away from its adjacent short side container in a direction of a longitudinal direction of the container, thus creating a passage of about 3 m between the containers, so that a vehicle may drive through that passage. If it is necessary to compensate for the loss of safety and protection when creating the passage between the containers, an array of one or more containers filled with a filling material may be positioned out of the containers array, opposite the passage between the containers, and distanced away therefrom, thus preventing any damages by a nearby explosion. The array may be formed along a straight line, or it may have an L-shape for protecting the vehicles and troops during entrance into the shelter inner space.

The invention claimed is:

1. A containers shelter comprising:

a base array comprising a plurality of containers; and a second floor comprising a plurality of containers, wherein the containers have a top surface partially cut away to allow filling the containers with filling material, wherein the containers are fully filled with filling material selected from the group consisting of local sand, earth, stones, gravel, concrete, reinforced concrete, and any combination thereof, and wherein the second floor is supported solely by the base array to form a confined inner space.

2. The containers shelter according to claim 1, wherein the base array is formed from 20 foot ISO containers.

3. The containers shelter according to claim 1, wherein the second floor is formed from 40 foot ISO containers.

4. The containers shelter according to claim 1, wherein the base array further comprises an entrance container.

5. The containers shelter according to claim 4, wherein the entrance container comprises an outer opening, an inner opening remote from the outer opening and transversely directed thereto, and a separation wall extending between the outer opening and the inner opening up to an entire height of the entrance container.

6. The containers shelter according to claim 1, wherein the base array and the second floor are connected to each other by twist-lock fasteners.

7. The containers shelter according to claim 1, wherein at least a part of the containers is provided from within with sliding rails along at least one of the longitudinal walls of the container and a pre-cast reinforced concrete wall is slidingly inserted into the rails.

8. The containers shelter according to claim 7, wherein at least a part of the containers provided with pre-cast reinforced concrete wall is filled with a filling material.

9. The containers shelter according to claim 1, wherein at least one of the containers of the base array of containers is a passageway-container having a passage therethrough.

10. The containers shelter according to claim 1, wherein at least two of the containers of the base array of containers are spaced apart to create a passage therebetween.

11. The containers shelter according to claim 10, wherein at least one container, filled with a filling material, is placed opposite the passage and distanced away therefrom.

12. The containers shelter according to claim 1, wherein at least one container comprises a slanted protective plate that extends internally from a container corner, adjacent a long wall of the container, to an opposite container corner and wherein a slanted space formed between the slanted protective plate and the long wall of the container rising from the container corner is filled with filling material.

13. The containers shelter according to claim 1, wherein an external wall of at least one container is provided with a pair of vertically extending rails, and a vertical protective plate is placed between the rails.

14. The containers shelter according to claim 13, wherein the vertical protective plate is formed from steel or pre-cast reinforced concrete or is an active protection plate.

* * * * *